US005343660A

United States Patent [19]

Caoduro et al.

[11] Patent Number: 5,343,660

[45] Date of Patent: Sep. 6, 1994

[54] SCAFFOLD TUNNEL

[76] Inventors: Paolo Caoduro, Via Europa, 15 Zane (Vicenza); Carlo Caoduro, Via Chiuppese, 15 Monticello Conte Otto (Vicenza) both of Italy

[21] Appl. No.: 905,362

[22] Filed: Jun. 29, 1992

[30] Foreign Application Priority Data

Aug. 5, 1991 [IT] Italy ..... PD91 U 000079

[51] Int. Cl.[5] ..... E04B 1/32

[52] U.S. Cl. ..... 52/86; 52/200

[58] Field of Search ..... 52/86, 200, 87; 16/348

[56] References Cited

U.S. PATENT DOCUMENTS

| | | | |
|---|---|---|---|
| 1,693,169 | 11/1928 | Young | 16/348 |
| 3,849,953 | 11/1974 | Cohen | 52/86 |
| 4,587,776 | 5/1986 | Leurent | 52/200 |
| 4,593,710 | 6/1986 | Stafford et al. | 52/86 |
| 4,850,167 | 7/1989 | Beard et al. | 52/200 |

FOREIGN PATENT DOCUMENTS

| | | | |
|---|---|---|---|
| 0023969 | 2/1981 | European Pat. Off. | 52/86 |
| 3529971 | 3/1987 | Fed. Rep. of Germany | 52/86 |
| 0554376 | 4/1977 | U.S.S.R. | 52/200 |

*Primary Examiner*—Carl D. Firedman
*Assistant Examiner*—Christopher Todd Kent

[57] ABSTRACT

The subject matter of the invention is a scaffold tunnel for civil and industrial engineering applications, comprising a section bar secured to a fixed support and having mounted thereon, at predetermined spacings over the full length of the tunnel, a plurality of hinge mountings each composed of a bearing block and a hinged body. A metal scaffold secured to these hinge mountings is composed of hollow base section bars and hollow vault section bars of any suitable curvature adapted to have cover sheets of glass or a plastic material mounted thereon.

The overall construction is completed by a plurality of suitable configured sealing gaskets, a corresponding plurality of finish section strips and a plurality of safety tensioners (FIG. 2 Tab. II).

16 Claims, 13 Drawing Sheets

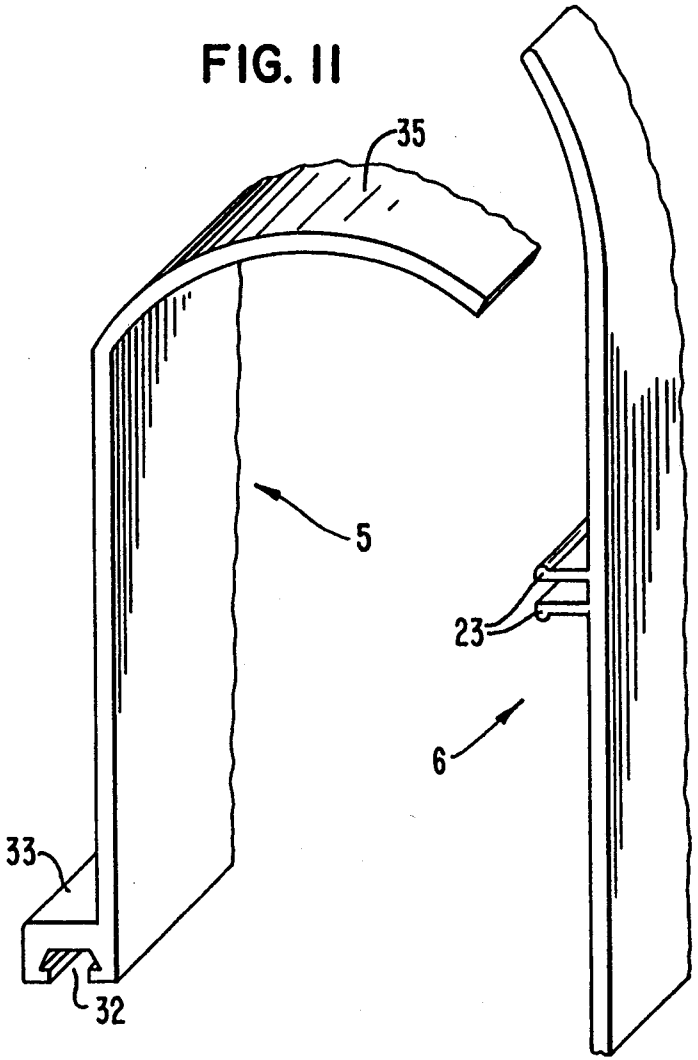
FIG. 11
FIG. 12
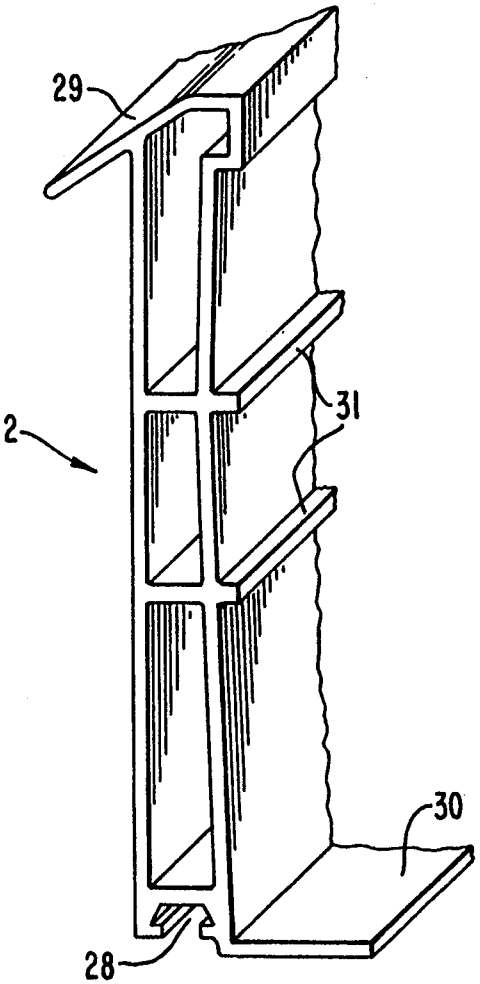
FIG. 10

SCAFFOLD TUNNEL

The present invention relates to a scaffold tunnel covered with glass sheets or sheets made of impact-resistant metacrylate, polycarbonate or other plastic material, for use as a covered passage between separate buildings in civil and industrial engineering applications.

Depending on thermal or acoustic insulation requirements, the tunnel may be of a single-walled, double-walled or otherwise multiple-walled construction.

The tunnel comprises a metal scaffolding composed of hollow base section bars and hollow vault section bars of any suitable curvature, the latter being of any suitable curvature (steep vault, low vault, semicircular vault and the like) in the form of aluminum extrusions of any suitable section and height. The tunnel is completed by securing on this metal scaffold cover sheets made of glass, impact-resistant metacrylate and/or other suitable plastic materials.

The metal scaffolding is carried by a suitable number of hinge mountings each composed of a bearing block and a hinged body, and mounted at predetermined spacings over the full length of the tunnel, and in particular at the junctions of the base section bars and vault section bars, on respective mounting section bars themselves secured to a fixed support of concrete, for instance.

The overall construction is finally completed by a variety of suitably configured sealing gaskets made of rubber or other resilient materials acting to limit the heat exchange between the exterior and interior of the tunnel, a plurality of inner and outer cover section strips, and a number of safety tensioners acting to ensure the stability of the construction as a whole.

A characteristic of the invention is the provision of a hinged mounting assembly secured to a mounting section bar and permitting the above described metal scaffolding to be assembled rapidly and in a simple manner, regardless of the configuration and curvature of the actual vault, while in addition imparting remarkable resiliency to the structure in view of deformations caused by variations of ambient temperature. Another characteristic is the employ of particularly shaped sealing gaskets mainly for the purpose of limiting the heat exchange between the exterior and the interior of the tunnel. Finally the employ of specifically designed safety tensioners ensures the stability and strength of the structure as a whole. The functionality and appearance of the tunnel are finally improved by the employ of suitably shaped internal and external finish section strips.

Figure 1:
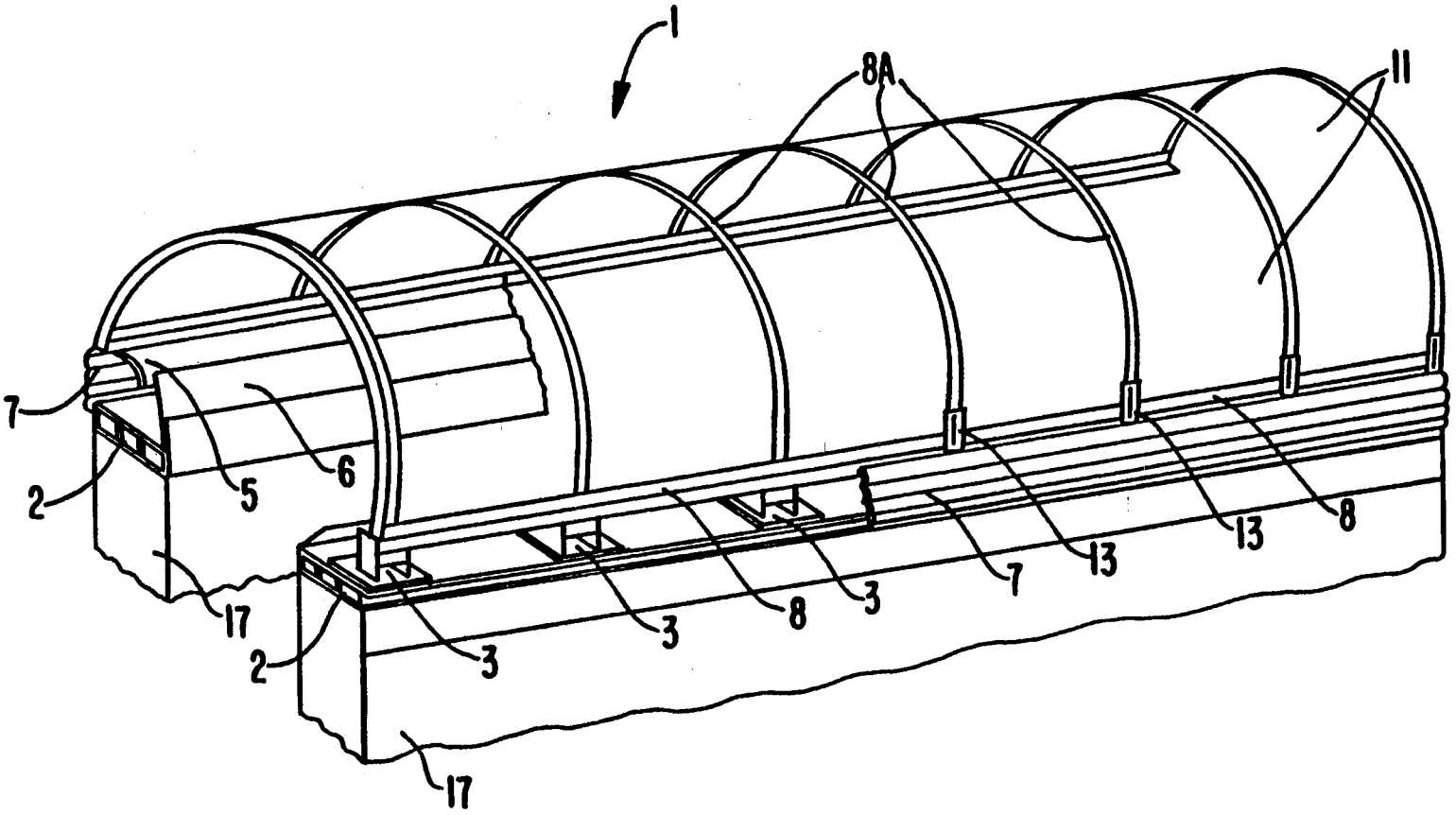
Figure 2:
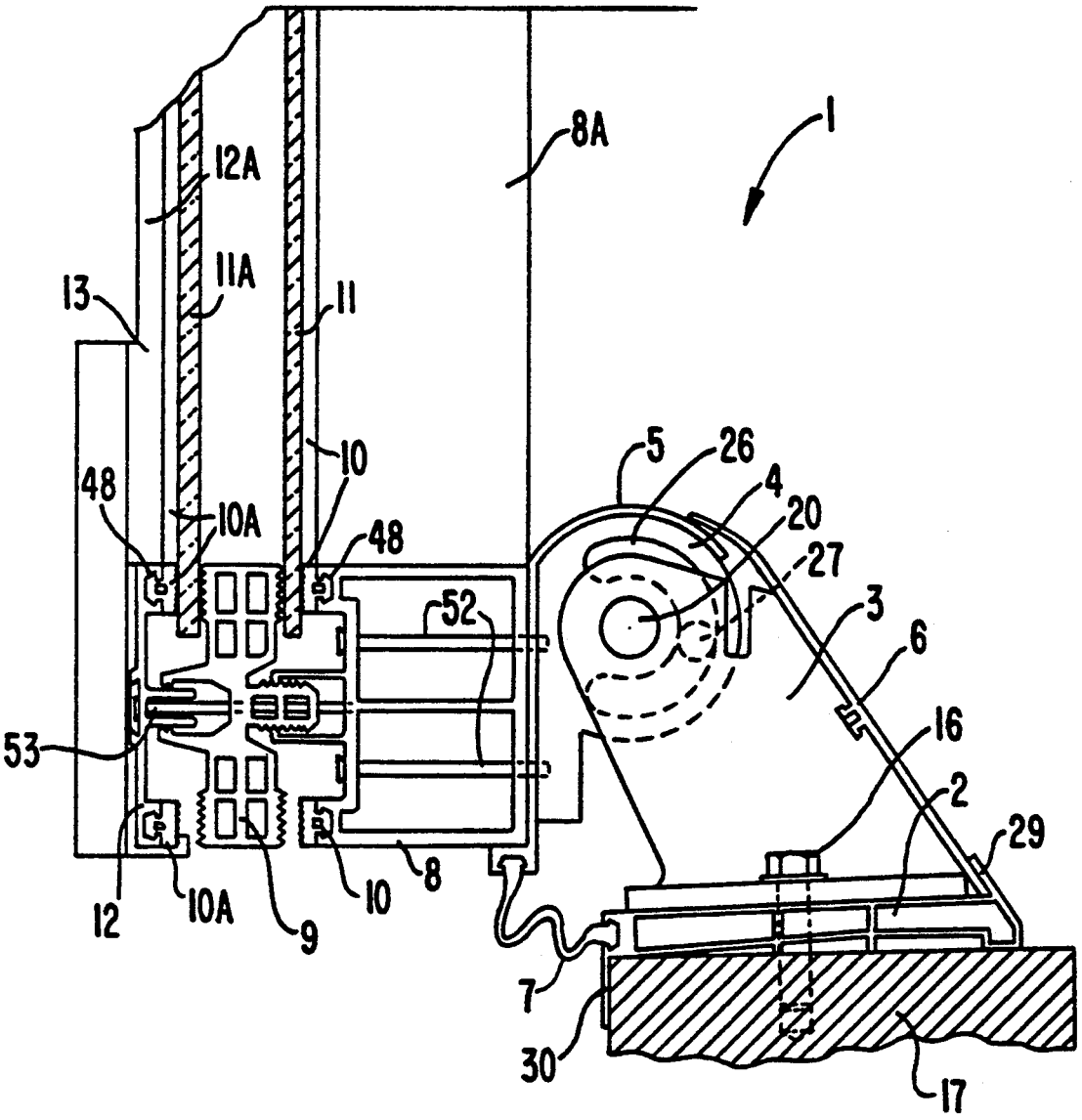
Figure 3:
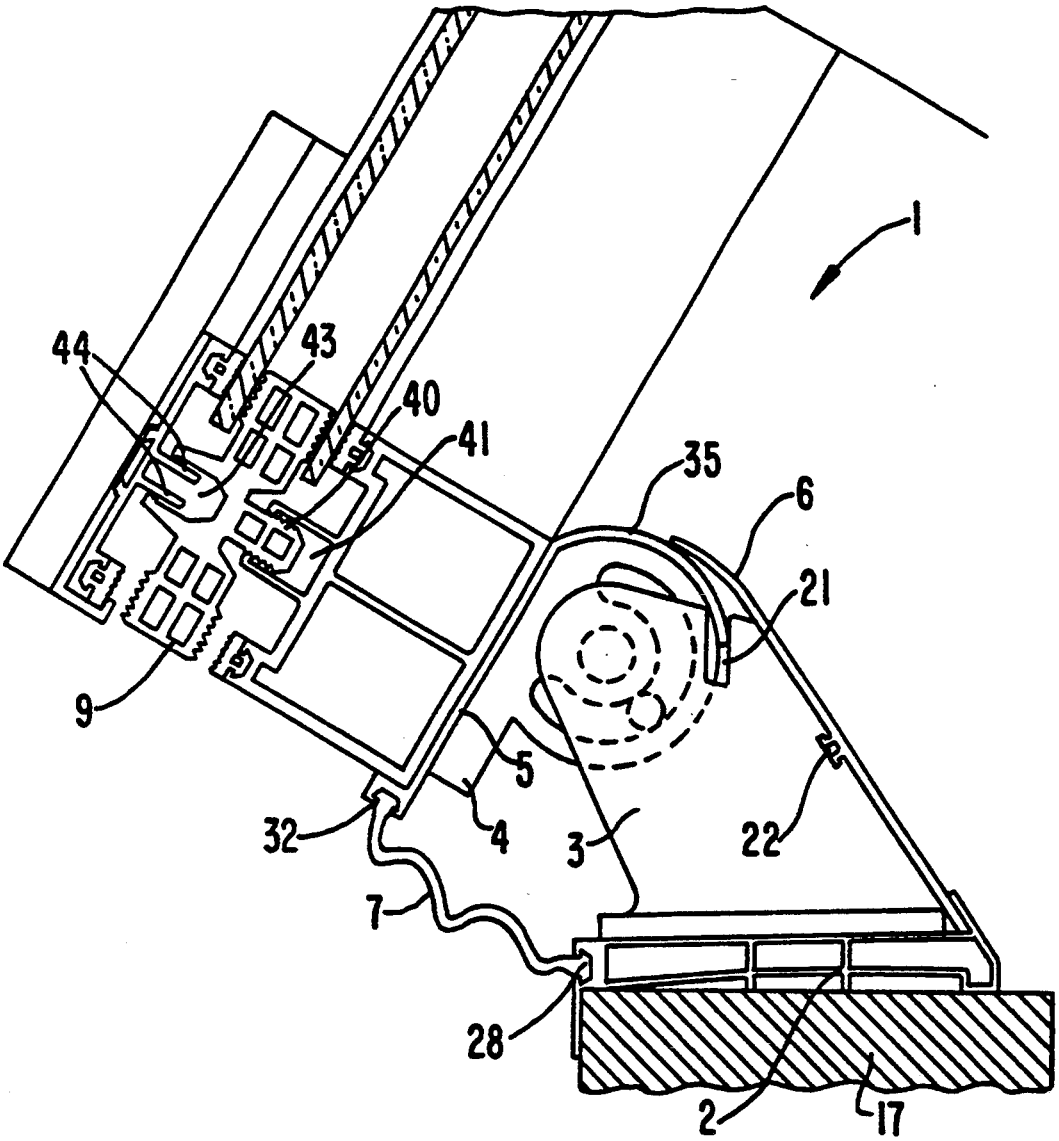
Figure 4:
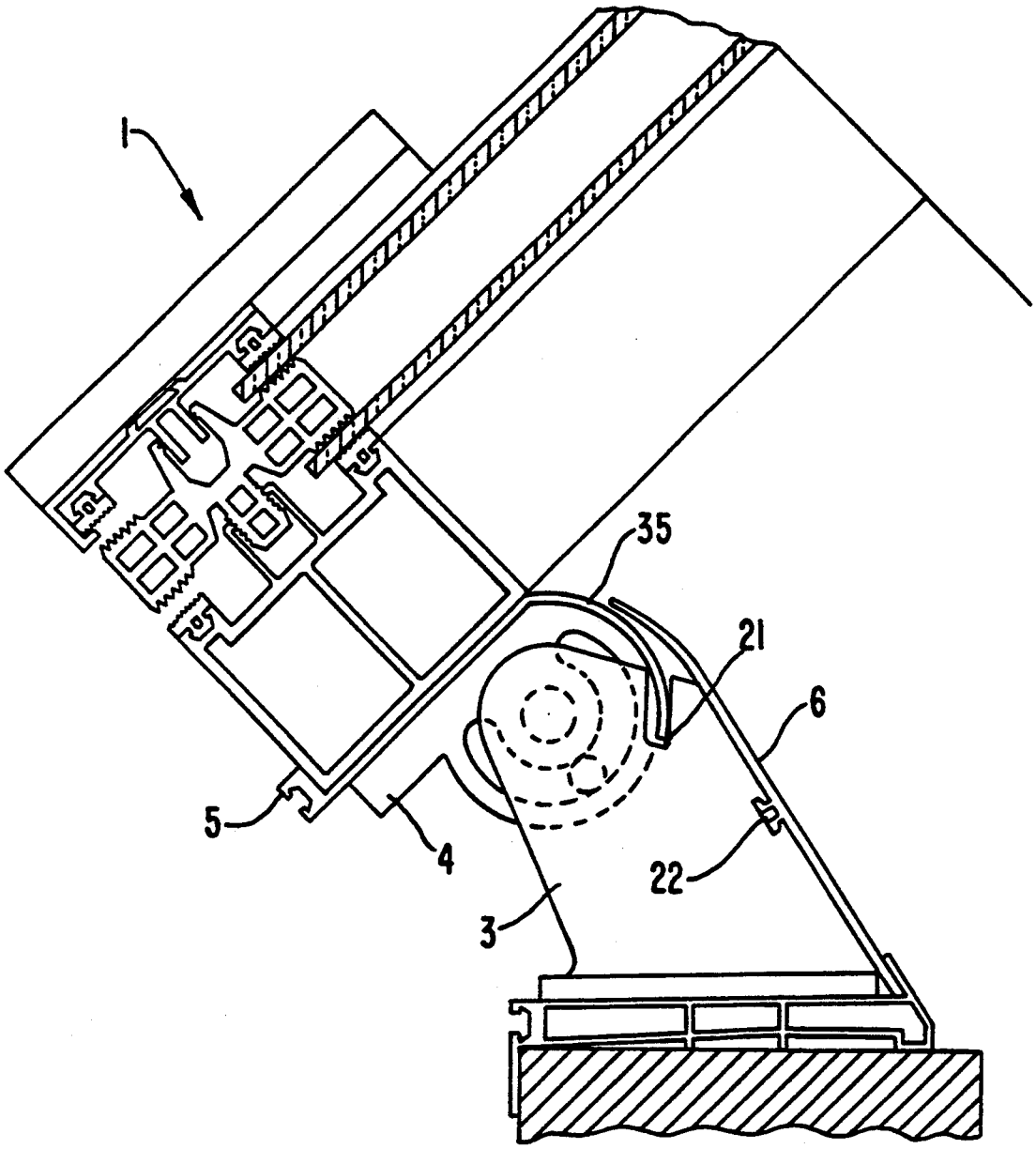
Figure 5:
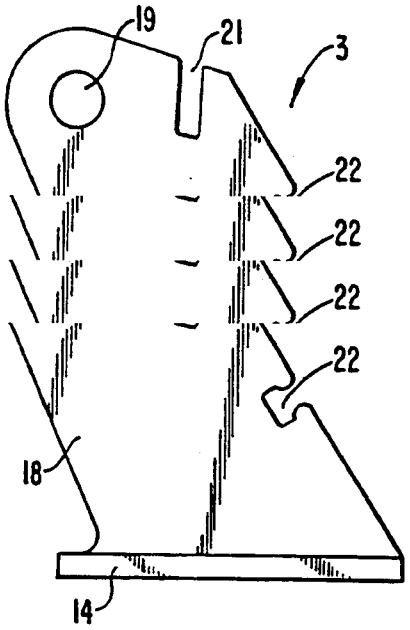
Figure 6:
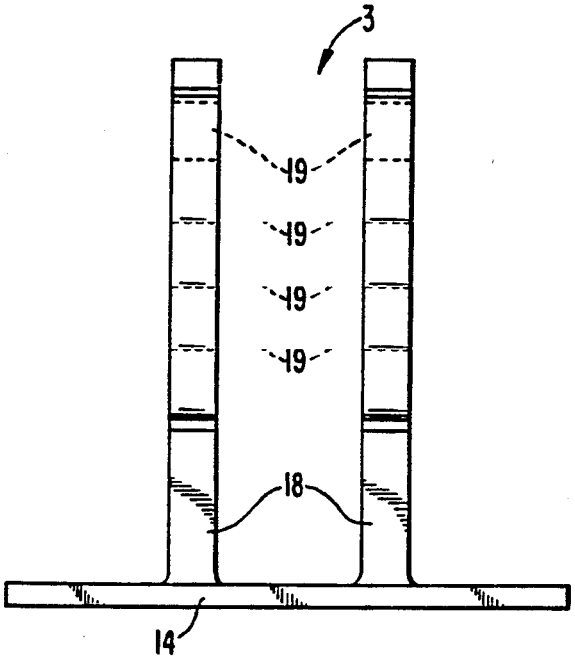
Figure 7:
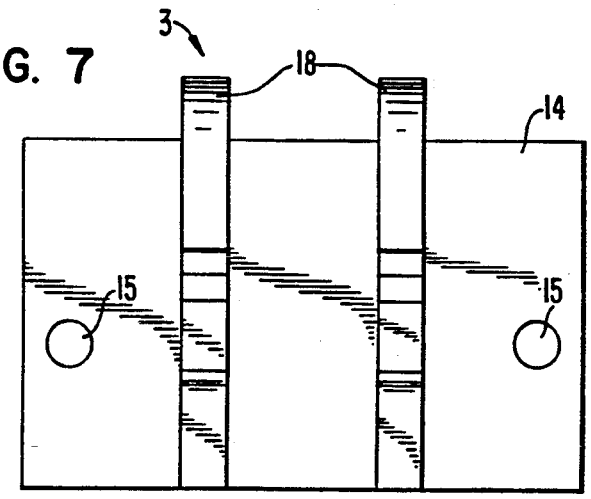
Figure 8:
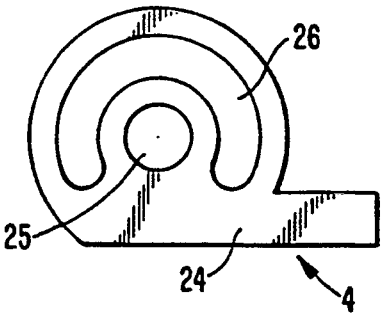
Figure 9:
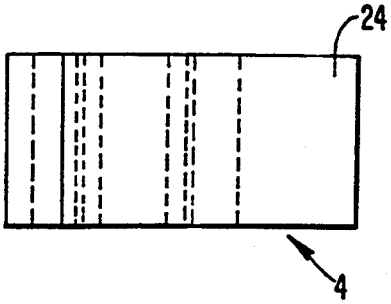
Figure 13:
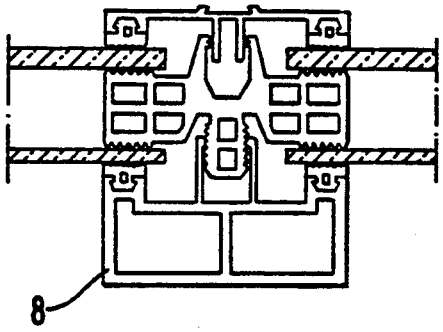
Figure 14:
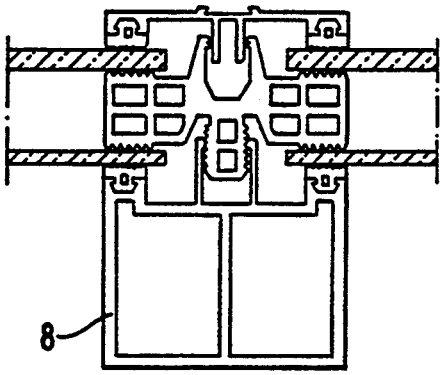
Figure 15:
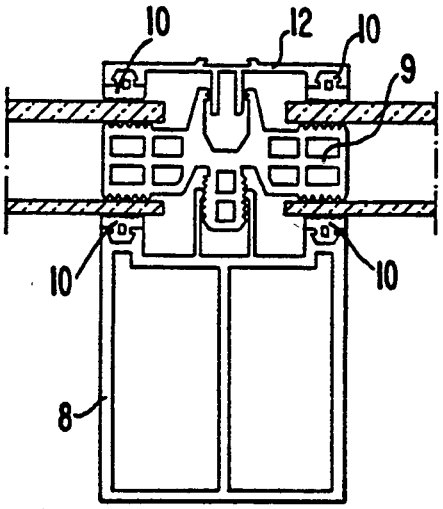
Figure 16:
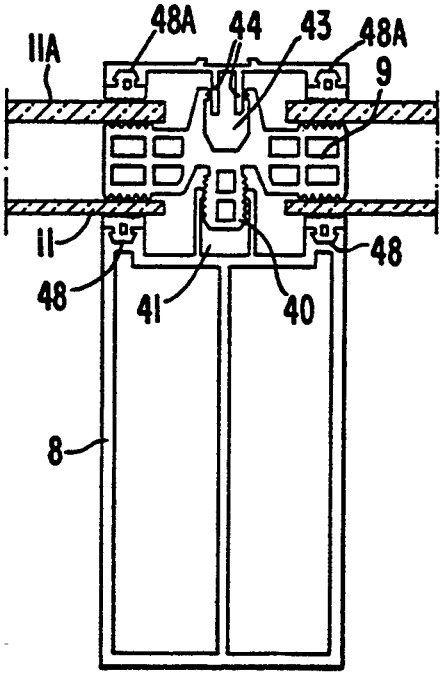
Figure 17:
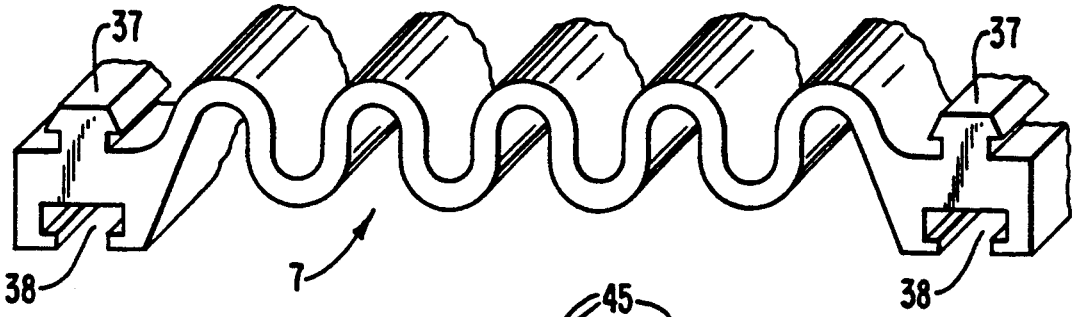
Figure 18:
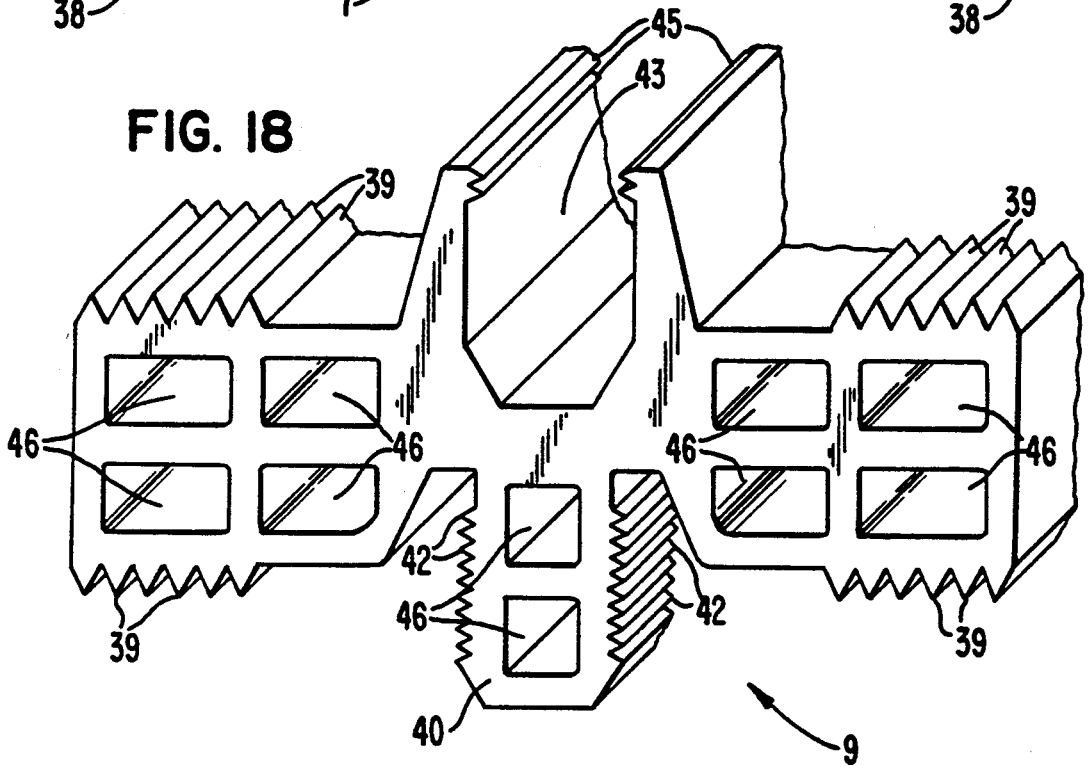
Figure 19:
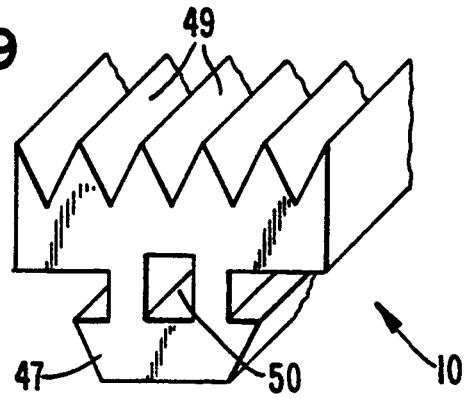
Figure 20:
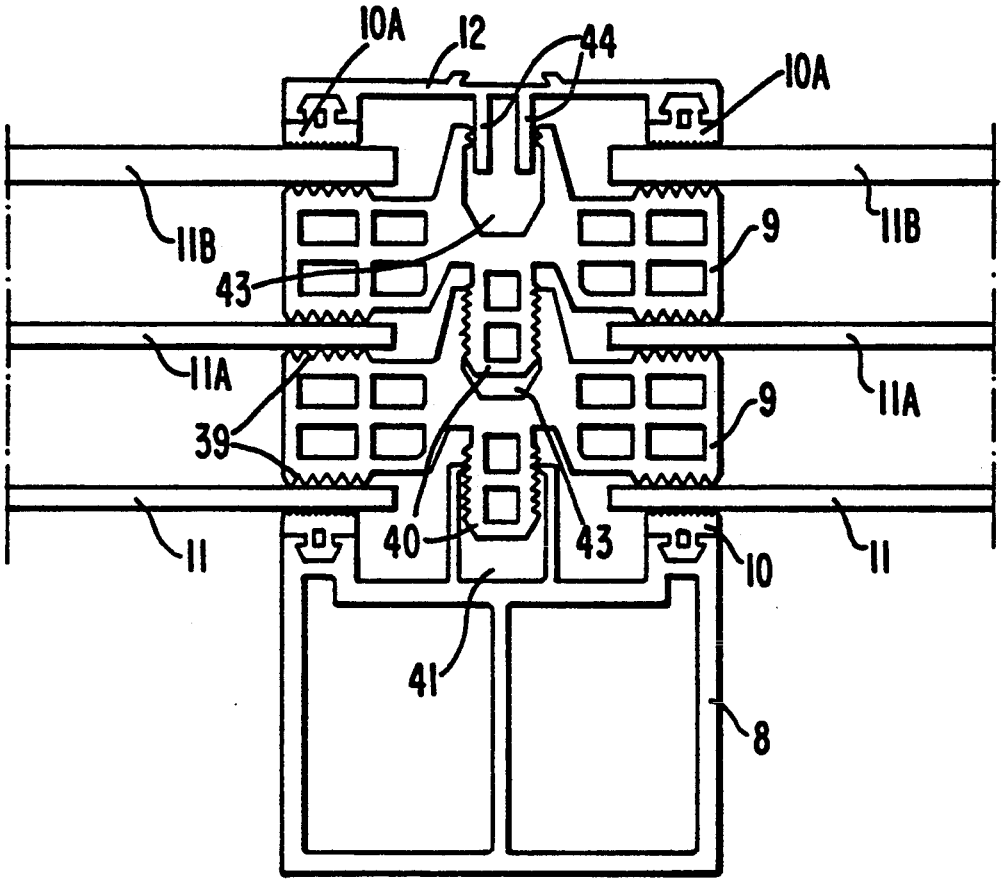
Figure 22:
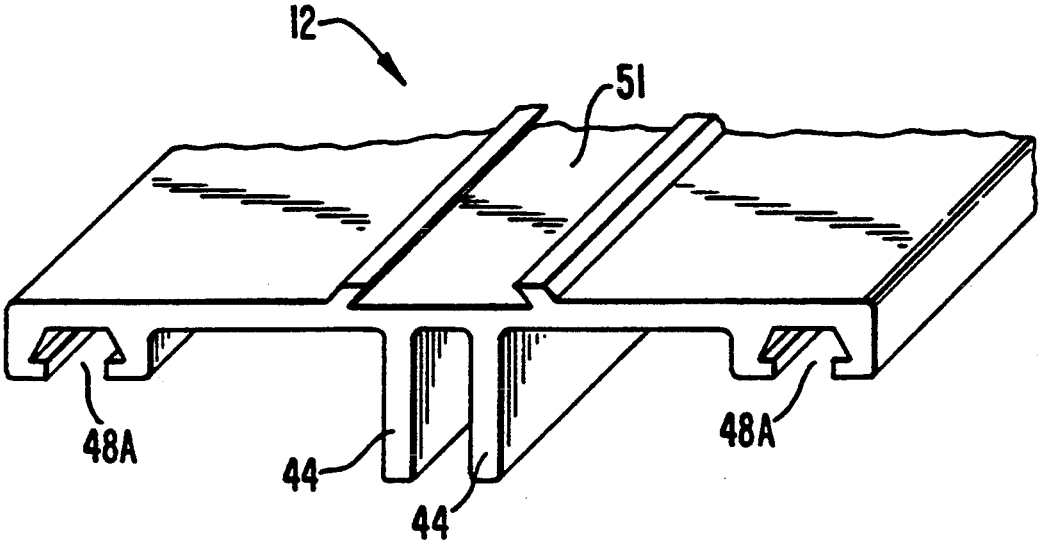
Figure 21:
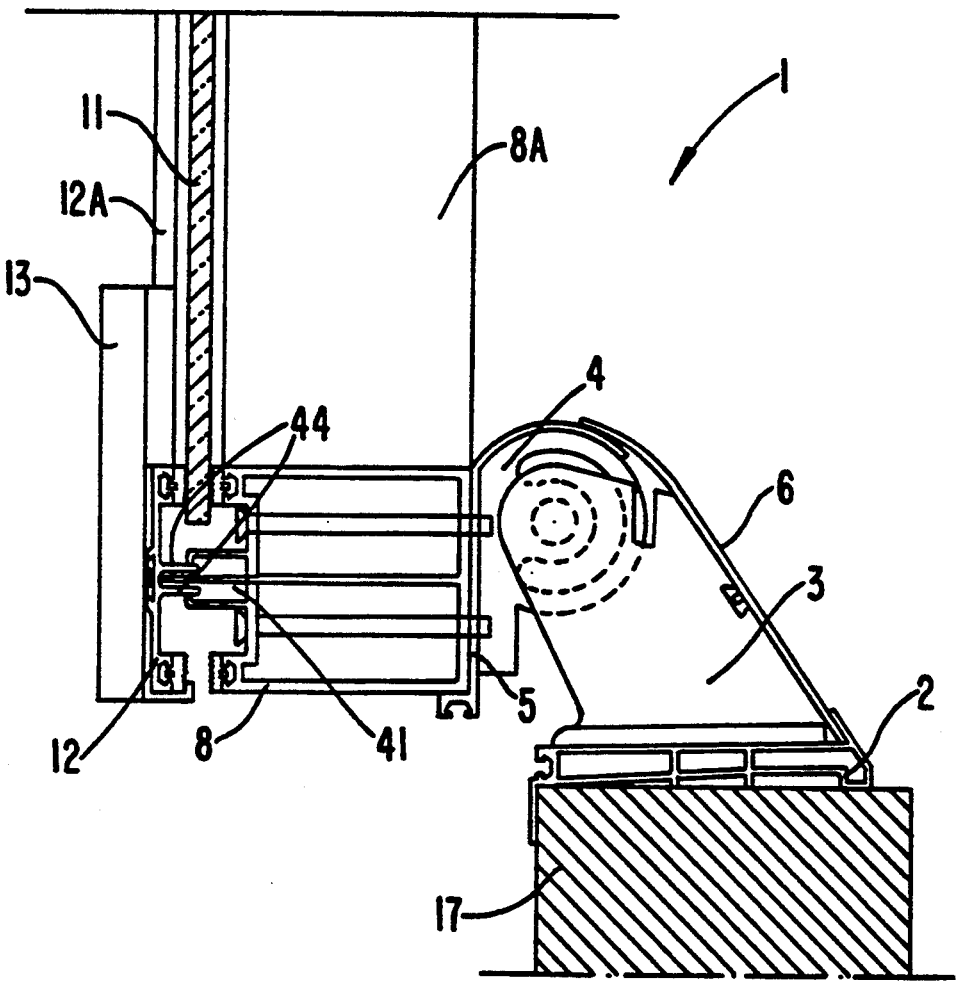
Figure 23:
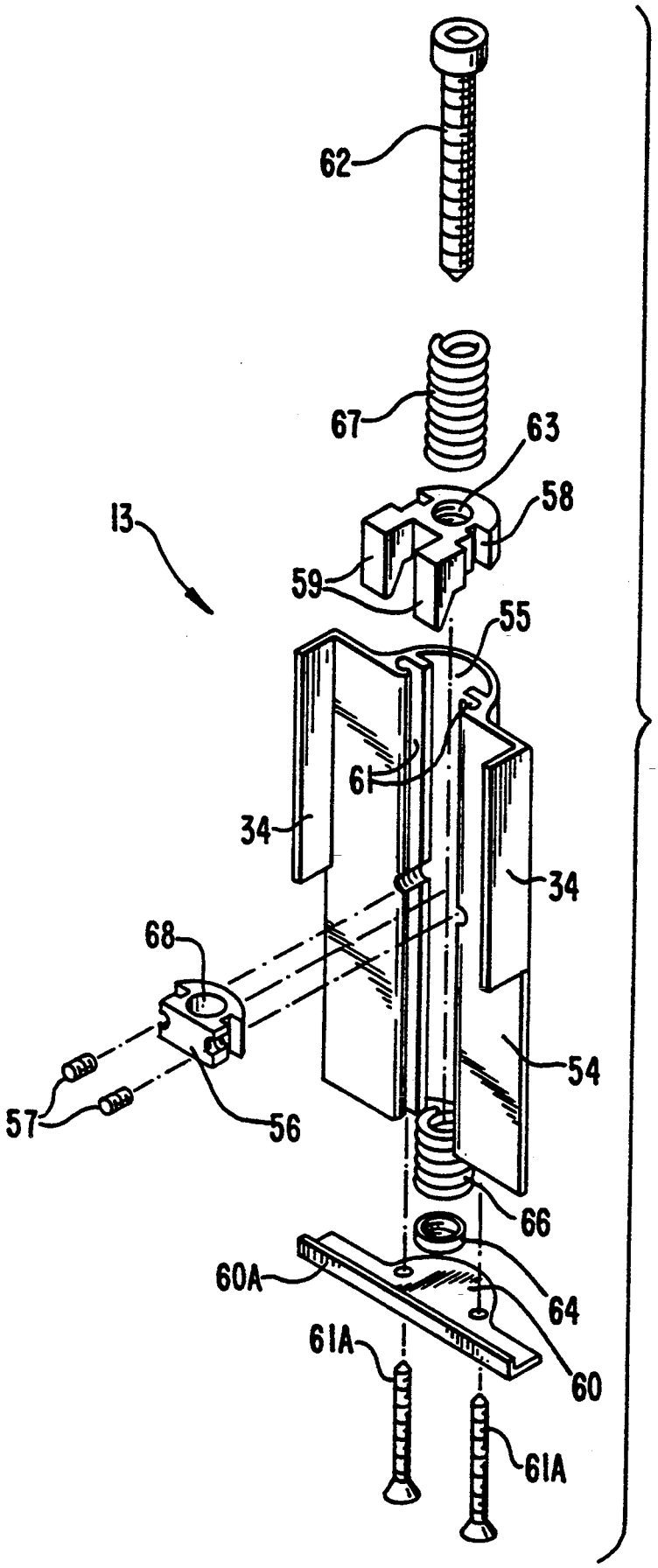
Figure 24:
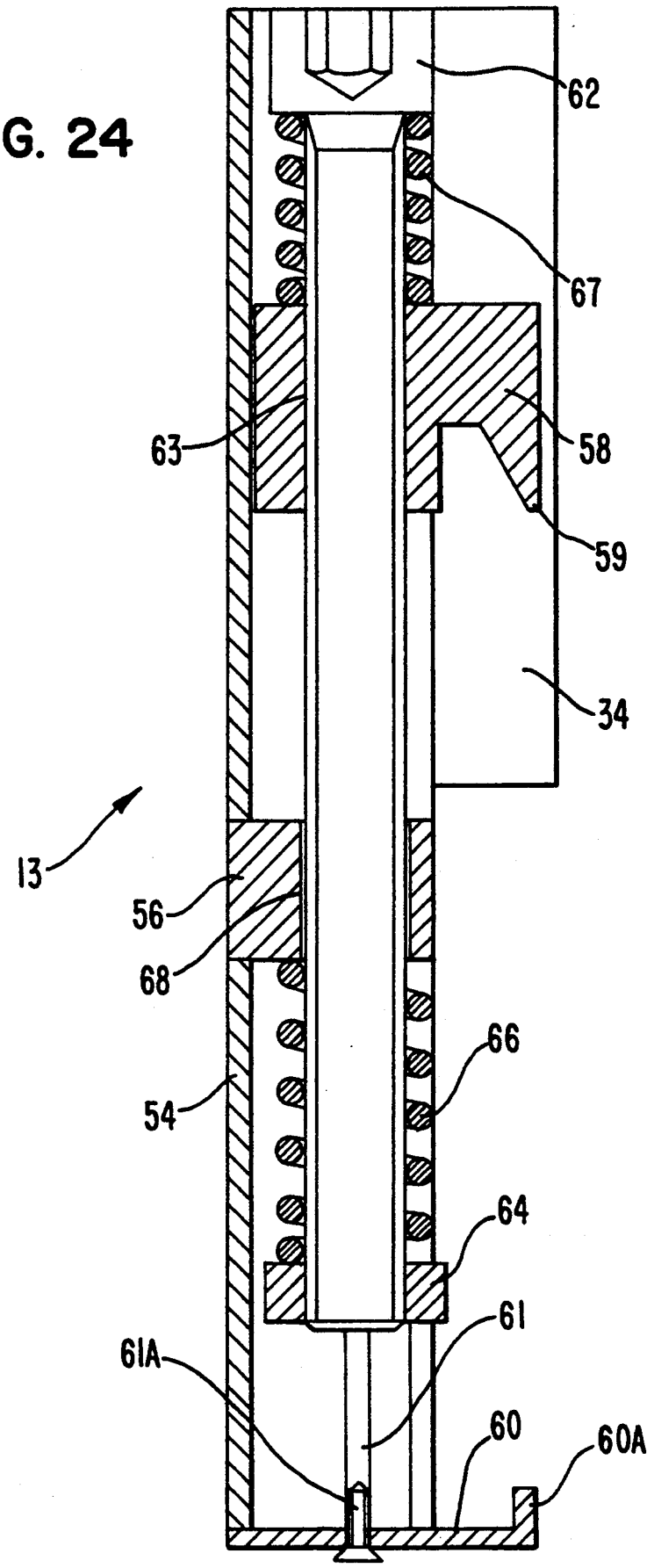
Figure 25:
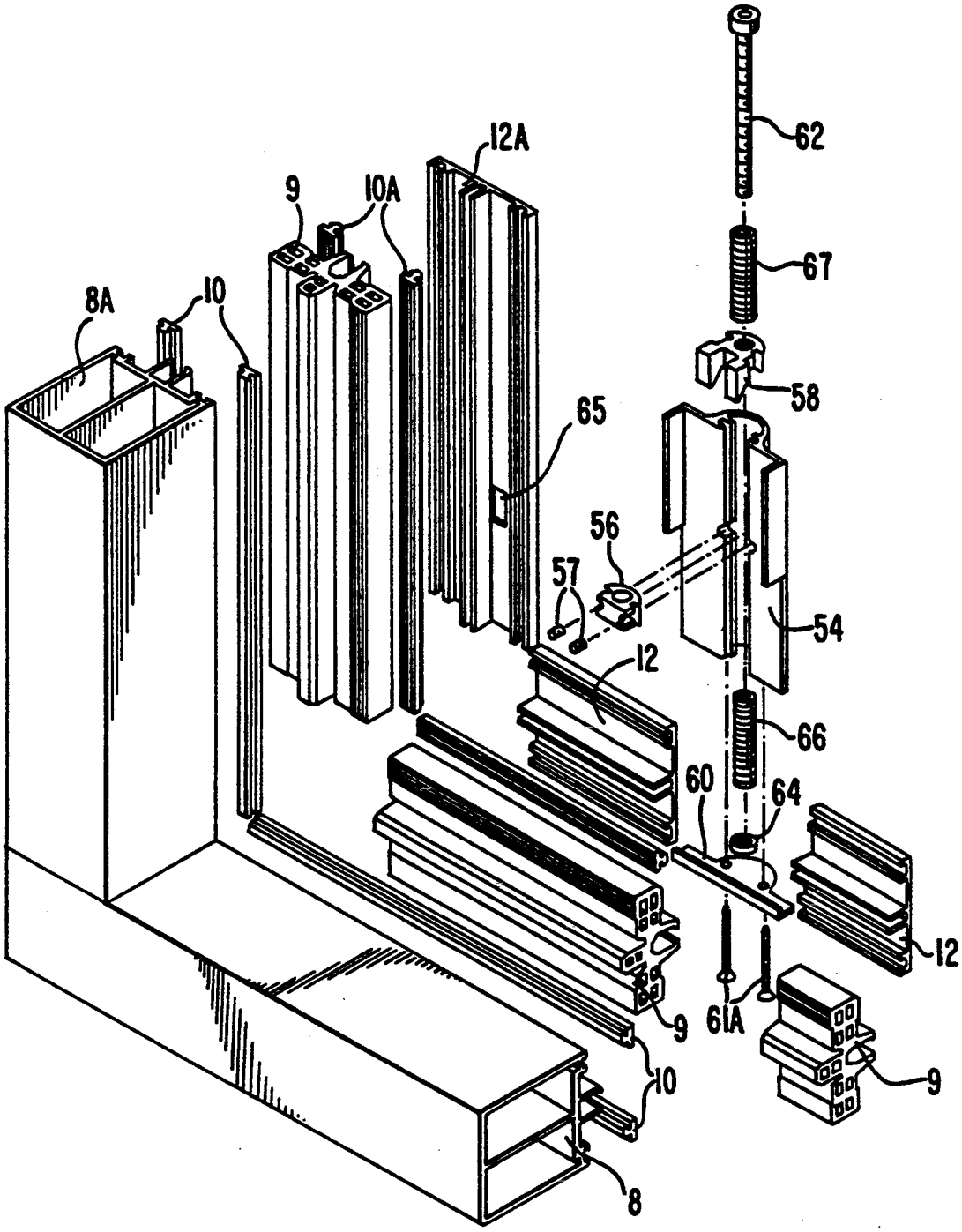

An embodiment of the invention shall now be described by way of example with reference to the accompanying drawings, wherein:

FIG. 1 shows an overall perspective view of a tunnel construction according to an embodiment of the invention, FIGS. 2, 3 and 4 show sectional views of hinged mounting structures for tunnels in the vertical position and at inclinations of 30° and 45°, respectively, FIGS. 5, 6 and 7 illustrate a hinge mounting bearing block as viewed from three sides, FIGS. 8 and 9 illustrate two views of a hinged body of a hinge mounting assembly, FIG. 10 shows a perspective view of a base mounting section bar, FIG. 11 shows a perspective view of a hinge mounting inner cover member, FIG. 12 shows a perspective view of a hinge mounting outer cover member, FIGS. 13, 14 15 and 16 show sectional views of hollow section bars of different height to be used for base section bars or vault section bars, FIG. 17 shows a perspective view of a piece of a lateral sealing gasket, FIG. 18 shows a perspective view of a piece of an intermediate sealing insert, FIG. 19 shows a perspective view of a piece of a support sealing strip, FIG. 20 shows a sectional view of a detail of a triple-walled scaffold tunnel, FIG. 21 shows a sectional view of a detail of a single-walled scaffold tunnel, FIG. 22 shows a perspective view of a piece of an outer finish section strip, FIG. 23 shows an exploded view of a safety tensioner, FIG. 24 shows a sectional side view of the tensioner in its assembled state, and FIG. 25 shows an exploded view of a detail of a metal scaffold for a double-walled tunnel, complete with sealing gaskets, an outer finish strip and a safety tensioner.

As illustrated particularly in FIGS. 1 and 2, the present scaffold tunnel 1 comprises a base mounting section bar 2 extending over the full length of the tunnel and secured by means of screws 16 to a fixed mounting support 17 of concrete, for instance.

Mounted on base section bar 2 at predetermined spacings over the full length of tunnel 1, in particular connected with the junctions between hollow base section bars 8 and hollow vault section bars 8*a*, are individual bearing blocks 3 each provided with a hinged body 4 mounted therein by a journal pin 20.

Secured to hinged bodies 4 by means of screws 52 is a respective scaffold base section bar 8, with an inner hinge mounting cover member 5 interposed therebetween.

Secured to scaffold hollow base section bars 8 at predetermined spacings, specifically at the locations of hinge mounting assemblies 3, 4, are hollow vault section bars 8*a*, both base section bars 8 and vault section bars 8*a* being provided with support sealing strips 10 for the support thereon of cover sheets 11 made of glass and/or a plastic material.

In the case of a double-walled scaffold tunnel as shown by way of example in FIG. 2, intermediate sealing inserts 9 are provided to act as spacers between inner cover sheets 11 and outer cover sheets 11*a* likewise made of glass and/or a plastic material. The outer finish of the tunnel is formed by finish section strips 12, 12*a*, provided with support sealing strips 10*a* and fixed in place by means of screws 53.

The described structure is finally completed and stabilized by tensioners 13. As particularly shown in FIGS. 5, 6 and 7, a bearing block 3 is substantially of the shape of an inverted Greek letter "pi", with a mounting base 14 provided with bores 15 for the passage of screws 16 used for securing bearing block 3 on mounting base section bar 2 (FIG. 2). Bearing block 3 further has two upstanding walls 18 formed with bores 19 for the passage of journal pin 20 carrying the associated hinged body 4 (FIG. 2), with cutouts 21 for receiving therein, at the moment of rotation, the arcuate rim portion 35 of inner cover member 5, as particularly shown in FIGS.

2, 3, 4, and with dovetail cutouts 22 adapted to receive and retain therein a complementary pair of dovetail ribs 23 provided on the inner side of outer cover member 6 (FIG. 12).

As shown in FIGS. 8 and 9, hinged body 4 comprises a base plate 24 acting as a seat for inner cover member 5 (FIG. 11) and hollow base section bar 8 (FIG. 2) to be secured thereto by means of screws 52, a bore 25 for the passage therethrough of journal pin 20 connecting hinged body 4 to bearing block 3, and a part-circular arcuate slot 26 for receiving therein a pin 27 secured to bearing block 3 for limiting the pivot angle of hinged body 4 (FIG. 2).

The number of hinged mounting assemblies 3, 4 and their spacing along the length of the tunnel can be suitably selected in accordance with the weight of the scaffold structure, depending on its being covered with glass or plastic sheets in a single- or multiple-walled construction with a vault of a longer or shorter span.

As particularly shown in FIG. 11, inner cover member 5, which extends over the full length of the tunnel, has a lower ledge 33 adapted to support hollow base section bar 8 thereon, and formed at its bottom side with a dovetail groove 32 for the retention therein of a bead 37 provided along one side of a lateral sealing gasket 7 (FIG. 17). The arcuate rim portion 35 is provided for covering and protecting hinged bodies 4 and acts to improve the appearance of the finished tunnel on its inside.

As particularly shown in FIG. 12, outer cover member 6, the length of which is likewise equal to that of the tunnel for improving the protection and outside appearance of the finished structure, is formed at its inside with projecting ribs 23 adapted to be received and retained in dovetail cutouts 22 of bearing block 3.

As particularly shown in FIG. 10, base mounting section bar 2, which extends over the full length of the tunnel and is secured to mounting support 17 by means of screws 16, is formed with a dovetail groove 28 for the retention therein of a bead 37 formed along the other side of lateral finish gasket 7, an inclined rim portion 29 for concealing the lower edge portion of outer cover member 6, a depending rim portion 30 extending along the outer side-wall surface of mounting support 17 for preventing any infiltration of air or liquids into the tunnel, and a plurality of ribs 31 acting to improve the strength of the base mounting section bar 2.

As particularly shown in FIG. 17, lateral sealing gasket 7 is made of rubber or another resilient material of poor heat conductivity, with an undulating or zig-zag folded cross-sectional shape for accomodating the pivoting of the hinge mountings during assembly of the tunnel. The gasket is installed on the outside over the full length of the tunnel so as to prevent the infiltration of air or liquids into the tunnel.

Along its upper and lower longitudinal rims, lateral sealing gasket 7 is formed with beads 37 adapted to be received and retained in dovetail grooves 32 of inner cover member 5 and 28 of base mounting section bar 2, respectively (FIG. 3).

Adjacent to its upper and lower longitudinal rims, lateral sealing gasket 7 is additionally formed with dovetail grooves 38 adapted to receive and retain an additional similar sealing gasket 7 which may be employed for improving the thermal and acoustic insulation and for preventing any infiltrations.

As evident from FIGS. 13, 14, 15 and 16, the hollow section bars used for base section bars 8 and vault bars 8*a*, the latter being differently arcuate according to the desired kind of covering, may be of different height to result in a lighter or heavier scaffold structure. At their outward facing sides, hollow section bars 8, 8*a* are formed with dovetail grooves 47 for the retention therein of the cover sheet support sealing strips 10, and with a cavity 41 for the retention therein of a downwards projecting central wall portion 40 of sealing insert 9, or of a downwards projecting central wall portion 44 of outer finish section strips 12, 12*a* in the case of a single-walled scaffold tunnel.

The sealing insert 9 illustrated in FIG. 18 is made as an extrusion of rubber or another resilient material of poor heat conductivity, with specific additional characteristics such as mechanical strength and resistance to wear and degradation. The insert 9 is applied to vault section bars 8*a* and hollow base section bars 8 over the full length of the tunnel so as to provide a temperature barrier between the inside and the outside of the tunnel and to substantially prevent any kind of infiltration.

In detail, sealing insert 9 comprises corrugated surface portions 39 for contact with cover sheets 11, 11*a*, a downwards projecting central wall portion 40 with corrugated side faces 42 adapted to be received in a sealing manner in the cavities 41 of hollow section bars 8 and 8*a*, and an upwards or outwards opening cavity 43 formed with corrugated lips 45 for the retention therein of the downwards projecting central wall portions 44 of outer finish section strips 12, 12*a*. Insert 9 is additionally formed with closed internal cavities 46 for further improving its thermal insulating properties.

As particularly shown in FIG. 20, two or more sealing inserts 9 may be coupled to one another by inserting the downwards projecting central wall portion 40 of a second sealing insert 9 into the upwards facing cavity 43 of a first insert, to thereby give support to a plurality of cover sheets 11, 11*a*, 11*b* made of glass or any other material, resulting in a triple- or multieple-walled structure of a scaffold tunnel.

The cover sheet support sealing strip 10 illustrated in FIG. 19 is likewise made as an extrusion of rubber or another resilient material of poor heat conductivity, and formed with a dovetail-shaped bead 47 adapted to be retained in dovetail grooves 48 and 48*a* formed in hollow section bars 8 and in outer finish section strips 12, 12*a*. Sealing strip 10 is additionally provided with a closed cavity 50 and a corrugated contact face 49.

The outer finish section strip 12 illustrated in FIG. 22 is provided at its inner side with a pair of dovetail grooves 48*a* for the retention therein of support sealing strips 10, and a pair of downwards projecting ribs 44 adapted to be received in the outer cavity 41 of a respective hollow vault section bar 8*a* in the case of a single-walled tunnel construction (FIG. 21, or in the outer cavity 43 of a sealing insert 9 in the case of a double-wailed tunnel construction as shown by way of example in FIG. 3. On its outer side, strip 12 is formed with a shallow dovetail groove 51 at the location of which holes may suitably be drilled for receiving the screws 53 used for securing strip 12 to hollow section bars 8, 8*a*, with the interposition, if required, of a sealing insert 9 (FIG. 2). After completion of the tunnel construction, groove 51 may suitably be closed by an additional cover strip.

While the beads 37, 47 of the various sealing gaskets 7, 10 and the corresponding grooves 28, 32, 48, 48*a*, 38 of the various section bars 2, 5, 8, 12, 12*a* and of sealing gasket 7 have been shown to be of a substantially dovetail-shaped cross-sectional configuration, it is also possible within the scope of the invention to provide these elements with any other suitable shape, for instance a rounded, angular or prismatic cross-section, with a view to facilitate manufacturing operations and to optimize the thermal and acoustic insulation characteristics and the appearance of the finished structure.

As shown in FIG. 23, the safety tensioner 13 comprises a body 54 having a center portion of substantially semi-circular cross-sectional shape, with lateral flanges projecting therefrom. This center portion defines a passage 55 adapted to receive therein a stop member 56 of complementary cross-sectional shape to be secured in position by means of screws 57. Grooves 61 extend along the boundaries of passage 55. A slide member 58 of a cross-sectional shape corresponding to that of passage 55 is provided with a pair of projecting lugs 59 adapted to engage corresponding apertures 65 formed in a lower end portion of outer finish strip 12 (FIG. 25). The lower end of tensioner 13 is closed by a bottom piece 60 formed with a ledge 60*a* and secured to body 54 by means of self-threading screws 61*a* received in grooves 61. Tensioner 13 finally includes a tightening bolt 62, a pair of compensation springs 66, 67, and a threaded collar 64.

For properly assembling safety tensioner 13 in the manner depicted in FIG. 24, stop member 56 is inserted into passage 55 of body 54 and secured in position by screws 57. Bolt 62 is passed through spring 67 and then threaded into a threaded bore 63 of slide member 58. The latter is then inserted into passage 55, so that the projecting end portion of bolt 62 passes through a bore 68 formed in stop member 56. Spring 66 is then mounted on the lower end portion of bolt 62 and secured in place by threaded collar 64. To complete the assembly, bottom piece 60 is attached to body 54 by the engagement of self-cutting screws 61*a* in grooves 61.

The projecting lugs 59 of slide member 58 are then engaged in the apertures 65 of a (vertical) outer finish strip 12*a*, and ledge 60*a* of bottom piece 60 is brought into engagement with the lower edge of a (horizontal) outer finish strip 12, so that the latter is received in a close fit between bottom piece 60 and the lateral flanges 34 of tensioner body 54. Subsequently slide member 58 can be displaced downwards by acting on tightening bolt 62 to thereby securely stabilize the complete assembly. The compensation springs 66, 67 impart a certain resiliency to the tensioner, permitting it to yield to expansion and contraction of the structure in response to changing ambient temperature conditions.

We claim:

1. A scaffold tunnel comprising a metal scaffold structure supporting cover sheets made of glass or plastic material, characterized in that said metal scaffold structure comprises hollow base section bars (8) and hollow vault section bars (8*a*) mounted on hinged mounting structures, said mounting structures including a bearing block (3) and a hinged body (4) and secured on a base mounting section bar (2) of a length generally equal to that of the scaffold tunnel, and finish section strips (5, 6, 12, 12*a*) covering predetermined sections of said bearing (3) block and hinged body (4), shaped sealing strips (7, 8, 10) covering predetermined sections of said metal scaffold structure, and safety tensioners (13) connected to distal ends of said hollow vault section bars (8*a*).

2. A scaffold tunnel according to claim 1, characterized in hat said bearing block (3) of said hinged mounting structure comprises two upstanding walls (18) formed with cutouts (21, 22) for the accomodation therein of inner and outer cover members (5, 6), a journal pin (20) secured to said walls (18) carrying said hinged body (4), said pin being additionally formed with a part-circular slot (26) to be engaged by a pivot angle limiting pin(27).

3. A scaffold tunnel according to claim 2, characterized in that it is provided with a lateral sealing finish gasket (7) of a resilient material formed along lower and upper edges of said lateral sealing finish gasket with shaped beads (37) for connection to said base mounting section bar (2) and said inner cover member (5), and with grooves (38) adapted to have a second sealing finish gasket (7) connected thereto.

4. A scaffold tunnel according to claim 3, characterized in that said base mounting section bar (2) is formed with a lateral groove (28) for the retention therein of one of said shaped beads (37) of said lateral sealing finish gasket (7), and with rim portions (29, 30) acting to limit infiltrations of any nature.

5. A scaffold tunnel according to claim 2, characterized in that said inner cover member (5) comprises a groove (32) for the retention therein of one of said shaped beads (37) of said lateral sealing finish gasket (7), and an arcuate rim portion (35) for the protection of said hinged body (4).

6. A scaffold tunnel according to claim 2, characterized in that said outer cover member (6) is formed with shaped projections (23) for its rapid mounting in said cutouts (22) formed in said bearing block (3).

7. A scaffold tunnel according to claim 1, characterized in that said hollow base section bars (8) and hollow vault section bars (8*a*) are each on one side formed with grooves (48) for the retention therein of support sealing strips (10), and with an open cavity (41) for the retention therein of downwards projecting ribs (44) of said outer finish section strip (12), or of a downwards projecting central wall portion (40) of a sealing insert strip (9).

8. A scaffold tunnel according to claim 7, characterized in that said sealing insert strip (9) is formed with corrugated surface portions (39) for supporting said cover sheets thereon, a downwards projecting central wall portion (40) adapted to be received in respective open cavities (41, 43), an open cavity (43) for the retention therein of said ribs (44) of said outer finish section strip (12) or of said central wall portion (40) of another sealing insert strip (9), and with a number of continuous closed cavities (46).

9. A scaffold tunnel according to claim 7, characterized in that said shaped sealing insert strips (9) are adapted to be mounted by inserting its downwards projecting central wall portion (40) into the corresponding open cavity (43) of another sealing insert strip (9).

10. A scaffold tunnel according to claim 7, characterized in that said support sealing strips (10) are provided with shaped beads (47) adapted to be retained in the corresponding grooves (48, 48*a*), and with a continuous closed cavity (50).

11. A scaffold tunnel according to claim 1, characterized in that said outer finish section strip (12) is formed with grooves (48*a*), downwards projecting ribs (44), and a recessed seat (51).

12. A scaffold tunnel according to claim 1, characterized in that one of said safety tensioner (13) comprises a shaped body (54), a bottom piece (60) attached thereto and including a ledge (60*a*), a tightening bolt (62) disposed within said body and carrying compensation springs (66, 67) and a threaded collar (64), said tightening bolt (62) being in threaded engagement with a slide member (58) and extending through a fixed stop member (56).

13. A scaffold tunnel according to claim 12, characterized in that said slide member (58) is provided with projecting lugs (59) for engagement in apertures (65) formed in said outer finish section strip (12).

14. A scaffold tunnel according to claim 12, characterized in that said ledge (60*a*) of said bottom piece (60) one of said safety tensioners (13) is adapted to grip the lower edge of a respective outer finish section strip (12).

15. A scaffold tunnel comprising a metal scaffold structure supporting cover sheets made of glass or plastic material, characterized in that said metal scaffold structure comprises hollow base section bars (8) and hollow vault section bars (8*a*) mounted on hinged mounting structures, said mounting structures including a bearing block (3) and a hinged body (4) and secured on a base mounting section bar (2) of a length generally equal to that of the scaffold tunnel, and finish section strips (5, 6, 12, 12*a*) covering predetermined sections of said bearing block (3) and hinged body (4), shaped sealing strips (7, 9, 10) covering predetermined sections of said metal scaffold structure, and safety tensioners (13) connected to distal ends of said hollow vault section bars (8*a*); said bearing block (3) of said hinged mounting structures comprises two upstanding walls (18) formed with cutouts (21, 22) for the accommodation therein of inner and outer cover members (5, 6), a journal pin (20) secured to said walls (18) carrying said hinged body (4), said pin being additionally formed with a part-circular slot (26) to be engaged by a pivot angle limiting pin (27) and; a lateral sealing finish gasket (7) of a resilient material formed along its lower and upper edges with shaped beads (37) for connection to said base mounting section bar (2) and said inner cover member (5), and with grooves (38) adapted to have second sealing finish gasket (7) connected thereto.

16. A scaffold tunnel comprising a metal scaffold structure supporting cover sheets made of glass or plastic material, characterized in that said metal scaffold structure comprises hollow base section bars (8) and hollow vault section bars (8*a*) mounted on hinged mounting structures, said mounting structures including a bearing block (3) and a hinged body (4) and secured on a base mounting section bar (2) of a length generally equal to that of the scaffold tunnel, and finish section strips (5, 6, 12, 12*a*) covering predetermined sections of said block (3) and hinged body (4), shaped sealing strips (7, 9, 10) covering predetermined sections of said metal scaffold structure, and salty tensioners (13) connected to distal ends of said hollow vault section bars (8*a*); said tensioners (13) each comprising a shaped body (54), a bottom piece (60) attached thereto and including a ledge (60*a*), a tightening bolt (62) disposed within said body and carrying compensation springs (66, 67) and a threaded collar (64), said tightening bolt (62) being in threaded engagement with a slide member (58) and extending through a fixed stop member (56).

* * * * *